US011242227B2

(12) United States Patent
Cambruzzi et al.

(10) Patent No.: US 11,242,227 B2
(45) Date of Patent: Feb. 8, 2022

(54) METHOD AND ASSEMBLY DEVICE FOR CARRYING OUT AN INSTALLATION PROCESS IN AN ELEVATOR SHAFT OF AN ELEVATOR SYSTEM

(71) Applicant: Inventio AG, Hergiswil (CH)

(72) Inventors: Andrea Cambruzzi, Zurich (CH); Erich Butler, Ebikon (CH); Philipp Zimmerli, Harkingen (CH); Raphael Bitzi, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 742 days.

(21) Appl. No.: 16/092,014

(22) PCT Filed: Apr. 13, 2017

(86) PCT No.: PCT/EP2017/059017
§ 371 (c)(1),
(2) Date: Oct. 8, 2018

(87) PCT Pub. No.: WO2017/182396
PCT Pub. Date: Oct. 26, 2017

(65) Prior Publication Data

US 2019/0112159 A1 Apr. 18, 2019

(30) Foreign Application Priority Data

Apr. 20, 2016 (EP) ..... 16166260

(51) Int. Cl.
*B66B 19/00* (2006.01)
*B66B 7/02* (2006.01)
*B66B 11/00* (2006.01)

(52) U.S. Cl.
CPC ..... *B66B 19/00* (2013.01); *B66B 7/024* (2013.01); *B66B 7/027* (2013.01);
(Continued)

(58) Field of Classification Search
CPC ..... B66B 19/00; B66B 7/024; B66B 7/027; B66B 11/0005; B66B 19/002; B66B 19/007
(Continued)

(56) References Cited

U.S. PATENT DOCUMENTS 11,111,109 B2 * 9/2021 Cambruzzi ..... B66B 19/00
2015/0314992 A1 * 11/2015 Bolme ..... B66B 5/0087 52/741.1
(Continued)

FOREIGN PATENT DOCUMENTS

CN 105358468 A 2/2016
JP H05105362 A 4/1993
(Continued)

*Primary Examiner* — Jeffrey Donels
(74) *Attorney, Agent, or Firm* — William J. Clemens; Shumaker, Loop & Kendrick, LLP

(57) ABSTRACT

In a method for carrying out an installation process in an elevator shaft of an elevator system, an assembly device is inserted into the elevator shaft. The assembly device includes a support component, a mechatronic installation component retained by the support component and a control apparatus. At least one assembly apparatus (tool, sensor or component) is arranged on the support component. The support component is fixed in a fixing position in the elevator shaft. After the support component has been fixed, an actual position of the at least one assembly apparatus is determined relative to the installation component. Using the determined actual position relative to the support component, the at least one assembly apparatus is received by the installation component and an assembly step is carried out using the received at least one assembly apparatus.

13 Claims, 3 Drawing Sheets

(52) U.S. Cl.
CPC ..... *B66B 11/0005* (2013.01); *B66B 19/002* (2013.01); *B66B 19/007* (2013.01)

(58) Field of Classification Search
USPC ..... 187/393
See application file for complete search history.

(56) References Cited

U.S. PATENT DOCUMENTS

| | | | | |
|---|---|---|---|---|
| 2016/0311648 | A1* | 10/2016 | Vaarala | B66B 19/00 |
| 2016/0311657 | A1* | 10/2016 | Kilpelainen | B66B 19/002 |
| 2016/0311658 | A1* | 10/2016 | Kilpelainen | B66B 19/002 |
| 2016/0311659 | A1* | 10/2016 | Mertala | B66B 19/002 |
| 2017/0038204 | A1* | 2/2017 | Kilpelainen | G01C 3/08 |
| 2018/0208438 | A1* | 7/2018 | Cambruzzi | B66B 7/02 |
| 2019/0112159 | A1* | 4/2019 | Cambruzzi | B66B 19/007 |
| 2019/0367328 | A1* | 12/2019 | Cambruzzi | B32B 37/00 |
| 2020/0055709 | A1* | 2/2020 | Cambruzzi | G01B 5/25 |
| 2020/0165105 | A1* | 5/2020 | Zhao | B66B 19/002 |
| 2020/0299105 | A1* | 9/2020 | Cambruzzi | B66B 19/002 |

FOREIGN PATENT DOCUMENTS

| | | | |
|---|---|---|---|
| JP | 2005060066 | A | 3/2005 |
| JP | 4411371 | B1 | 2/2010 |
| WO | 2017016780 | A1 | 2/2017 |

* cited by examiner

METHOD AND ASSEMBLY DEVICE FOR CARRYING OUT AN INSTALLATION PROCESS IN AN ELEVATOR SHAFT OF AN ELEVATOR SYSTEM

FIELD

The invention relates to a method for carrying out an installation process in an elevator shaft of an elevator system and to an assembly device for carrying out an installation process in an elevator shaft of an elevator system.

BACKGROUND

WO 2017/016780 A1 describes an assembly device and a method for at least partly automatically carrying out installation processes in an elevator shaft of an elevator system. The assembly device has a support component and a mechatronic installation component retained by the support component. Before an assembly step is carried out, the support component is brought into a fixing position in the elevator shaft in which it can absorb any forces arising without yielding during the assembly step. When the support component is brought into the fixing position, which may be carried out by locking against walls of the elevator shaft, this may result in deformation of the support component. This is in particular the case if the support component is located in the region of a door cut-out for a shaft door, since the support component does not have an abutment for support in the region of the door cut-out. Deformation of the support component may also occur if the walls of the elevator shaft are uneven. This deformation may lead to problems if the installation component is intended to receive an assembly means arranged on the support component, for example a screw.

JP H05 105362 A likewise describes an assembly device and a method for at least partly automatically carrying out installation processes in an elevator shaft of an elevator system. Before carrying out an assembly step, the assembly device is locked against walls of the elevator shaft.

SUMMARY

By contrast, the problem addressed by the invention is in particular to propose a method and an assembly device for carrying out an installation process in an elevator shaft of an elevator system in which it is ensured that the installation process is carried out. This problem is solved by a method and an assembly device according to the invention.

In the method according to the invention for carrying out an installation process in an elevator shaft of an elevator system, an assembly device is inserted into the elevator shaft. The assembly device comprises a support component and a mechatronic installation component that is retained by the support component and comprises a control apparatus. At least one assembly means is arranged on the support component. The support component is fixed in a fixing position in the elevator shaft. After the support component has been fixed, an actual position of the assembly means arranged on the support component is determined relative to the installation component. Using the determined actual position of the assembly means relative to the installation component, an assembly means is received by the support component by means of the installation component and an assembly step is carried out using the received assembly means.

By determining the actual position of the assembly means arranged on the support component relative to the installation component after the support component has been fixed in the fixing position, it is ensured that the installation component can always be received by the support component and can thus be used for carrying out an assembly step. It is thus ensured that a planned assembly step can also be executed. The actual position of the assembly means relative to the installation component can, owing to deformation of the support component, so significantly differ from an initial position before fixing and thus without deformation of the support component that, without determining the actual position of the assembly means, the installation component would not be able to "find" the assembly means. It therefore would not be able to receive the assembly means and thus would not be able to execute the intended assembly step. It would thus not be possible to carry out the installation process. Determining the actual position of the assembly means relative to the installation component in accordance with the invention ensures that the installation component always receives the assembly means, even after fixing and thus even after potential deformation, and therefore the planned assembly step can be carried out.

The above-mentioned steps are executed in particular in the described order, but a different order is also conceivable. Furthermore, other steps that are not mentioned may also be carried out multiple times or between the above-mentioned steps.

In this case, an installation process is for example understood to mean attaching or orienting a component, for example what is known as a rail bracket lower part, in an elevator shaft.

The support component of the assembly device may have various designs. For example, the support component may be designed as a simple platform, framework, scaffold, car, or similar. The support component in particular comprises an upper part, a lower part, and side parts. In this case, dimensions of the support component are in particular selected such that the support component can be easily received in the elevator shaft and can be moved within said elevator shaft in the main extension direction thereof. The main extension direction of the elevator shaft is understood to be the direction in which an elevator car of the completed elevator system is moved. The main extension direction thus extends in particular vertically, but it may also be inclined relative to the vertical or may extend horizontally. In this case, the upper part and the lower part are predominantly oriented transversely to the main extension direction and the side parts are predominantly oriented in the main extension direction. In this case, a mechanical design of the support component is in particular selected such that it can reliably support the mechatronic installation component retained thereby and forces that may be exerted by the installation component when carrying out an assembly step can be supported.

The installation component of the assembly device is intended to be mechatronic, i.e. it is intended to comprise interacting mechanical, electronic and information-technology elements.

For example, the installation component may comprise a mechanism suitable for allowing assembly tools to be handled as part of an assembly step, for example. In this case, the assembly tools can for example be brought into the assembly position in a suitable manner by the mechanism and/or can be guided in a suitable manner during an assembly step. Alternatively, the installation component itself may also have a suitable mechanism which forms an assembly tool. Said assembly tool may for example be designed as a drill or a screwdriver.

Electronic elements or modules of the mechatronic installation component may for example be used to actuate or control mechanical elements or modules of the installation component in a suitable manner. Electronic elements or modules of this type are thus used as a control apparatus of the installation component. The control apparatus of the installation component may be arranged on the support component or also at another point within or outside the elevator shaft. The control apparatus of the installation component may also undertake tasks independently of the installation component. Other control apparatuses may also be provided which exchange information with one another, divide up control tasks and/or monitor one another. If reference is made to a control apparatus in the following, this is referring to one or more of these control apparatuses.

Furthermore, the installation component may have information-technology elements or modules, which can for example be used to deduce the position which an assembly tool is in and/or how the assembly tool is intended to be actuated and/or guided in said position during an assembly step.

In this case, interaction between the mechanical, electronic and information-technology elements or modules takes place in particular such that, as part of the installation process, at least one assembly step can be carried out semi-automatically or fully automatically by the assembly device.

The assembly device is in particular fixed in the fixing position relative to the elevator shaft such that the support component of the assembly device can move within the elevator shaft in a direction transverse to the main extension direction during an assembly step in which the installation component is in operation and exerts transverse forces on the support component, for example. For this purpose, the assembly device may in particular comprise a fixing component which may for example be designed to be supported or locked laterally on the walls of the elevator shaft, such that the support component can no longer move relative to the walls in the horizontal direction. For this purpose, the fixing component may for example have suitable supports, props, levers or similar.

In this case, an assembly means or assembly apparatus is understood to mean both assembly tools required for carrying out an assembly step and consumable material that is consumed during an assembly step, i.e. is fastened to a wall of the elevator shaft, for example. Assembly tools may for example be grippers, drills, screwdrivers or sensors that can be received by the installation component. Consumable materials may for example be screws, bolts, washers or what are known as rail bracket lower parts, which can be received by the installation component, in particular by means of a previously received assembly tool, and can be fastened to a wall, for example. The installation component may thus in particular also receive a plurality of the same or different assembly means in succession or simultaneously.

The actual position of the assembly means relative to the installation component may be determined in a completely different way. It may for example be determined by the assembly means being "sought" by the installation component using a probe or a scanner. It is likewise possible for an image of the support component to be recorded by a camera after fixing, and then for the assembly means and thus the position thereof to be determined by means of image processing. Furthermore, other approaches to determining the actual position of the assembly means are possible.

The assembly means does not have to be arranged directly on the support component, but may also be arranged in a magazine arranged on the support component, for example. The assembly means is therefore arranged indirectly on the support component. In this case, receiving an assembly means by the support component by means of the installation component should be understood to mean that the installation component receives the assembly means that is arranged directly or indirectly on the support component. If the assembly means is designed as an assembly tool, the installation component uses the assembly means to carry out an installation step, i.e. a drill for drilling a hole in a wall of the elevator shaft, for example. If the assembly means is designed to be a consumable material, for example in the form of a screw, the installation component screws the screw into a hole provided therefor in a wall of the elevator shaft.

A plurality of assembly means is in particular arranged on the support component. In this case, it may in particular be sufficient for only the actual position of an assembly means to be identified, and the actual positions of the other assembly means are extrapolated from this one actual position. In this approach, it is assumed that the positions of the individual assembly means relative to one another have not changed, or have only changed minimally, due to the fixing of the support component.

The actual position of an assembly means may for example also be determined by the actual position of a reference point being determined and, proceeding therefrom, the actual position of the assembly means being determined. For example, a plurality of assembly means, for example screws, may be arranged in a magazine on the support component. In this case, the actual position of the magazine can be determined, for example by determining the actual position of one or two reference points of the magazine. Reference points may for example be corners of the magazine, or an assembly means, for example a screw in the magazine. The actual position of the screws can be extrapolated from the actual position of the magazine. In this approach, it is assumed that the magazine has not deformed, or has only deformed minimally, and the positions of the individual screws relative to the magazine have not changed, or have only changed minimally, due to the fixing of the support component.

The actual position of an assembly means can be directly determined as described and can in particular be stored for subsequent use in the control apparatus. It is however also possible for an initial position of the assembly means relative to an initial coordinate system to be stored in the control apparatus prior to fixing, and for a change of the initial coordinate system into an actual coordinate system to be identified. Proceeding from the change, the actual position of the assembly means can be determined by what is known as coordinate transformation from the initial position.

A movement component is in particular provided in order to move the assembly device within the elevator shaft in a main extension direction of the elevator shaft. For example, a drive installed in the elevator shaft in advance may be provided as the movement component. This drive may be provided solely for moving the installation component or may be designed as a drive machine that is subsequently used for the elevator system, which can be used to move an elevator car when installed and can be used to move the assembly device during the preceding installation process.

The movement component may have a different design in order to be capable of moving the assembly device within the elevator shaft.

For example, the movement component may either be fixed to the support component of the assembly device or to a retaining point at the top within the elevator shaft, and may comprise a tensionable, flexible support means such as a cable, a chain or a belt, one end of which is retained on the movement component and other end of which is fixed to the other element, i.e. to the retaining point at the top within the elevator shaft or to the assembly device, respectively.

In an embodiment of the invention, the installation component is retained by the support component by means of a retaining device, and the actual position of the assembly means relative to the retaining device is determined. The retaining device thus serves as a base for the installation component, and in particular forms the origin of a coordinate system of the installation component. By determining the actual position relative to the retaining device, the actual position relative to the origin of the coordinate system of the installation component is therefore determined. Therefore, transformations between different coordinate systems that may possibly be required can be carried out particularly easily.

In an embodiment of the invention, at least two magazines for assembly means are arranged on the support component, and the actual position of an assembly means in each magazine is determined. Therefore, a particularly high level of precision is made possible for determining the actual positions of the assembly means in the different magazines, in particular if the magazines are coupled to the support component at differing distances in the main extension direction of the installation component, in particular of the retaining device. For example, a first magazine may be coupled to the support component on the lower part and a second magazine may be coupled to said support component on a side part between the lower part and the upper part. This ensures that all the assembly means arranged on the support component can be received by the installation component. A magazine should be understood to mean in particular a device for receiving a plurality of assembly means, for example screws or assembly tools, which are not deformed when fixing the support component and therefore the relative positions of the assembly means in a magazine are not changed by the fixing. A magazine for consumable materials and a magazine for assembly tools, for example, may be arranged on the support component. In this case, as described above, the actual position of an assembly means can be determined directly or by identifying the actual position of one or more reference points.

In an embodiment of the invention, the actual position of the assembly means relative to the installation component is determined on the basis of an initial position of the assembly means stored in the control apparatus of the installation component and on the basis of deformation of the support component brought about by the fixing. Therefore, the actual positions of various different assembly means can be determined particularly simply and effectively.

The initial position of the assembly means is stored in the control apparatus in relation to the installation component, in particular relative to the retaining device. The initial position of the assembly means should be understood to mean the position of the assembly means relative to the installation component before fixing, i.e. when the installation component is not deformed. It is not necessary to determine the exact deformation of the support component caused by the fixing in this case. In order to carry out the method in accordance with this embodiment of the method according to the invention, it is instead sufficient for the "effects" of the deformation, for example a change in the position of an assembly means relative to the installation component or a change in the coordinate system of the installation component, to be determined.

The various assembly means, such as screws or assembly tools, have set positions on the support component, such that the initial positions of the various assembly means do not change and can thus be stored in the control apparatus of the installation component in particular as coordinates relating to an initial coordinate system of the installation component. In this approach, it is in particular assumed that the support component is only elastically deformed by the fixing, i.e. that it returns to its original state as it was before fixing once the fixing is complete. The deformation occurring when fixing the installation component may for example be described by a change of the initial coordinate system of the installation component into an actual coordinate system. The actual positions of the assembly means may for example be determined proceeding from the initial positions by means of a coordinate transformation from the initial coordinate system into the actual coordinate system. The required coordinate transformation therefore needs to be determined in order to determine the actual position.

The required coordinate transformation may in particular be determined by measuring an actual position of at least one reference point of the support component. Therefore, in an embodiment of the invention, the deformation of the support component is identified from an actual position measured by means of a sensor and an initial position of at least one reference point of the support component, which position is stored in the control apparatus of the installation component.

If the elevator shaft is considered to be cuboid, the deformation of the support component can simply be considered to be the displacement of an upper part relative to a lower part of the support component solely in a fixing direction. In addition, for the purpose of simplification, it may be assumed that a distance between the upper part and the lower part does not change. If the initial coordinate system of the installation component is selected such that an axis extends in the fixing direction, the actual coordinate system results from the displacement of the initial coordinate system in the fixing direction. Therefore, only the coordinates change in the displacement direction. The magnitude of the displacement may be determined by the actual position of a reference point being determined by means of a sensor. If the installation component is retained on the upper part or the lower part of the support component thereby, the reference point must not be arranged on the same part of the support component. If, for example, the installation component is retained on the upper part of the support component, and the retaining device is therefore arranged on the upper part, then the reference point is in particular arranged on the lower part of the support component. In general terms, a reference point should be selected such that its actual position differs from its initial position as much as possible, in particular in relation to the main extension direction relative to the retaining device. In all the assembly means of which the coupling to the support component is the same distance in the main extension direction from the retaining device as the coupling of the reference point, the coordinate in the displacement direction changes by the same magnitude as with the reference point. The distance in the main extension direction toward the retaining device should be understood to mean the distance from the coupling to the support component. If, as described, the reference point is thus coupled to the support component via the lower part, this applies to all the assembly means that are likewise coupled to the support component via the lower part. The assembly means may for example be coupled to the support component via a magazine arranged on the lower part.

Under said conditions, for assembly means of which the coupling to the support component is a different distance in the main extension direction from the retaining device than the coupling of the reference point, the magnitude of the change in the coordinate in the displacement direction changes in proportion to the change in said distance.

The approach described may also be repeated with a second reference point that is coupled to the support component at a different distance in the main extension direction from the retaining device. A second reference point may in particular be selected which is coupled to the support component at the same distance in the main extension direction toward the retaining device as a second magazine for assembly means. Therefore, the actual position of the second magazine and thus the actual positions of the assembly means arranged therein can be very precisely identified.

The fixing direction should be understood to mean the direction in which the support component is locked against the walls of the elevator shaft. Since there might be a plurality of elevator shafts beside one another, an elevator shaft always has a front wall comprising door cut-outs and an opposite rear wall, which also may, but does not have to, comprise door cut-outs, but said elevator shaft does not necessarily comprise side walls. The fixing therefore usually takes place against the front and the rear wall, and therefore the fixing direction extends between the front and the rear wall.

If it is desired or required that the actual position of the assembly means is determined more precisely, actual positions of additional reference points may be determined and the actual coordinate system of the installation component and the required coordinate transformation can be determined therefrom. If it is assumed that the support component does not rotate, it is sufficient to determine the actual positions of one reference point. If rotation about the different axes also needs to be taken into account, it is necessary to determine the actual positions of three reference points. It is also possible for the actual positions of more than one reference point to be determined per degree of freedom, and for an average of the results to be taken.

It is also possible for one or more actual positions of reference points and their associated initial positions to be used as scaling factors for what is known as a finite element calculation and for the overall deformation of the support component to thus be calculated.

Said sensor can in particular contactlessly determine the position of the reference point, for example the distance between the sensor and the reference point. The sensor may for example be designed as a laser scanner, a laser or ultrasound distance meter or a 3D digital camera having an associated evaluation unit. Therefore, it is possible to particularly precisely and simply determine the actual position of the reference point. In this case, the reference point may for example be designed as a defined corner of a magazine for assembly means from which a distance to the sensor is measured. Since the control apparatus actuates the installation component, the position of the sensor is known to said apparatus, and therefore the actual position of the reference point can be determined from the position of the sensor and the measured distance.

The sensor is in particular arranged on the installation component, and particularly is arranged in the fixing position on the installation component before the support component is fixed. The sensor is therefore also an assembly means within the meaning of this invention. Said sensor may for example be arranged in a magazine on the support component. So that said sensor can be securely received by the installation component, it needs to be received before fixing and therefore before any potential deformation of the support component.

In an embodiment of the invention, the sensor is rigidly arranged on the installation component. Said sensor is in particular arranged on a part of the installation component that is movable relative to the support component, and particularly is arranged as close as possible to an outer end of the installation component, for example on a self-supporting end of an industrial robot. Therefore, the installation component does not have to receive the sensor before each use, meaning that an installation process can be carried out in a particularly time-saving manner.

It is also conceivable for the sensor to be designed as a probe arranged on the installation component, with the actual position of the reference point therefore being measured by contact with the reference point.

In an embodiment of the invention, at least one deformation sensor is arranged on the support component, which is used to measure the magnitude of the deformation of the support component. Therefore, it is possible to particularly precisely determine the deformation of the support component. The deformation sensor may in particular be designed as one or more strain gages, by means of which stresses in the support component can be measured. On the basis of the measured stresses, the deformation of the support component can for example be determined by means of a finite element calculation. The strain gage(s) is/are in particular arranged at points with high stresses, i.e. for example on corners of the support component.

The deformation sensor may for example also be designed as an angular sensor which measures an angle or an angular change between components of the support component, for example the upper part and a connecting element to the lower part of the support component. The deformation of the support component can likewise be extrapolated from this angular change.

The above-mentioned problem is also solved by an assembly device for carrying out an installation process in an elevator shaft of an elevator system which comprises a support component and a mechatronic installation component that is retained by the support component, and comprises a control apparatus. The control apparatus is provided to determine an actual position of the assembly means of an assembly means arranged on the support component relative to the installation component and to actuate the installation component using the actual position of the assembly means such that it receives an assembly means and carries out an assembly step using the received assembly means. The assembly device is in particular provided to be moved in a main extension direction of the elevator shaft. In this case, the main extension direction of the elevator shaft should be understood to be the direction in which an elevator car of the completed elevator system is moved. The main extension direction thus extends in particular vertically, but it may also be inclined relative to the vertical or may extend horizontally.

In an embodiment of the invention, the control apparatus is provided to determine the actual position of the assembly means relative to the installation component on the basis of an initial position of the assembly means stored in the control apparatus and on the basis of deformation of the support component brought about by the fixing.

In an embodiment of the invention, a sensor is rigidly arranged on the installation component for measuring an actual position of a reference point.

In an embodiment of the invention, at least one deformation sensor is arranged on the support component, which can be used to measure the magnitude of the deformation of the support component.

In an embodiment of the invention, the deformation sensor is designed such that stresses in the support component can be determined. The control apparatus is provided to determine the deformation of the support component proceeding from the measured stresses.

The assembly device according to the invention has the same advantages as the above-described method according to the invention. The control apparatus may in particular be provided to execute the method steps of the above-described embodiments of the method according to the invention.

Further advantages, features and details of the invention can be found in the following description of embodiments and with reference to the drawings, in which like or functionally like elements are provided with identical reference signs.

DETAILED DESCRIPTION

Figure 1:
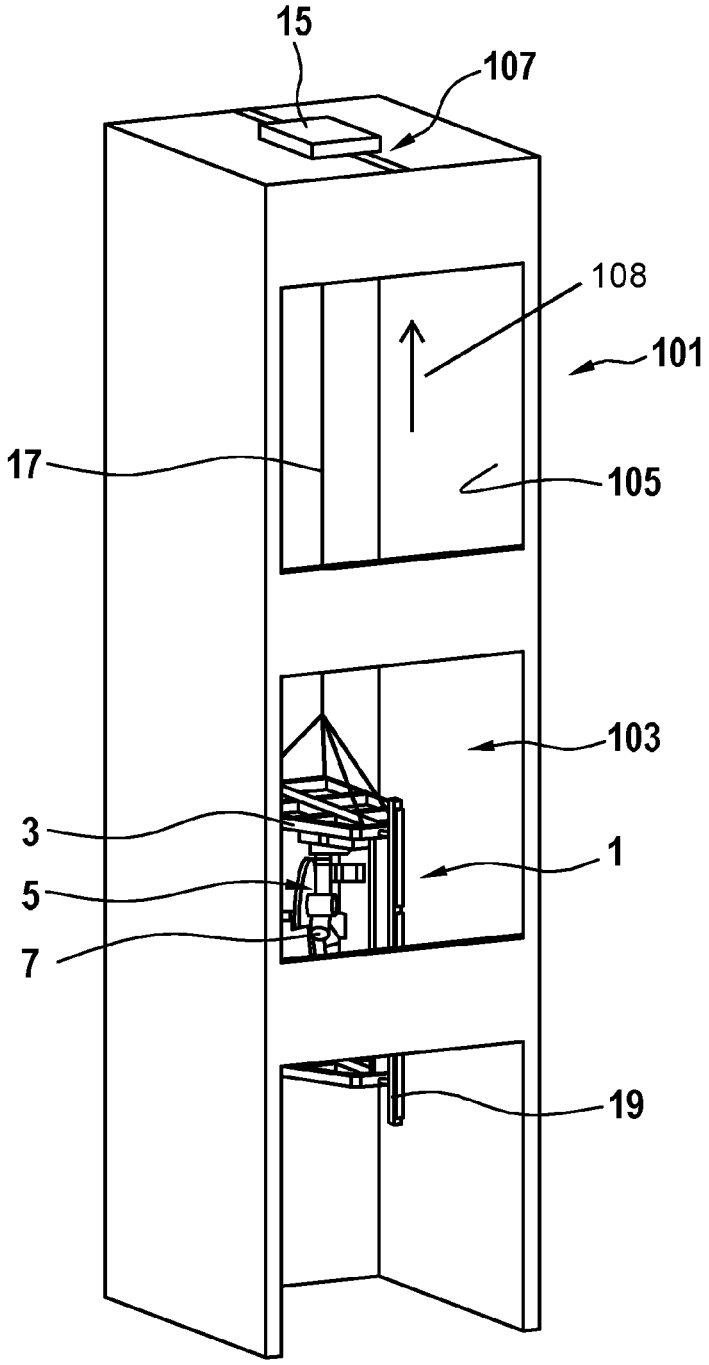
FIG. 1 is a perspective view of an elevator shaft of an elevator system with an assembly device received therein.

FIG. 1 shows an elevator shaft 103 of an elevator system 101, in which an assembly device 1 according to an embodiment of the present invention is arranged. The assembly device 1 comprises a support component 3 and a mechatronic installation component 5. The support component 3 is designed as a framework comprising an upper part 30 and a lower part 31 (see FIG. 2), the mechatronic installation component 5 being mounted on the upper part 30 by means of a retaining device 109. This framework has dimensions that allow the support component 3 to be moved within the elevator shaft 103 in a main extension direction 108 of the elevator shaft 103, and therefore to be moved vertically in this case, i.e. for example to move into different vertical positions at different floors within a building. In the example shown, the mechatronic installation component 5 is designed as an industrial robot 7, which is attached to the upper part 30 of the support component 3 via the retaining device 109 so as to hang down. In this case, an arm of the industrial robot 7 can be moved relative to the support component 3 and for example can be moved toward a wall 105 of the elevator shaft 103.

The support component 3 is connected to a movement component 15 in the form of a motor-driven cable winch by means of a steel cable serving as a support means 17, which winch is attached to the ceiling of the elevator shaft 103 at a retaining point 107 at the top of the elevator shaft 103. Using the movement component 15, the assembly device 1 can be moved within the elevator shaft 103 in the main extension direction 108, i.e. vertically over the entire length of the elevator shaft 103.

The assembly device 1 further comprises a fixing component 19 by means of which the support component 3 can be fixed within the elevator shaft 103 in the lateral direction, i.e. in the horizontal direction. The support component 3 is therefore brought into a fixing position in which the support component 3 is shown in FIG. 1. Props 25 (see FIG. 2) arranged on a rear face of the support component 3, of which a total of four are provided, two at the top and two at the bottom, may be moved backward and outward to fix the support component 3, and in this way lock the support component 3 between walls 105 of the elevator shaft 103 by means of the fixing component 19 and the props 25. In this case, the props 25 can for example be spread apart by means of hydraulics or similar, in order to fix the support component 3 in the elevator shaft 103 in the horizontal direction. It is likewise possible for the fixing component 19 to alternatively or additionally be moved outward.

Figure 2:
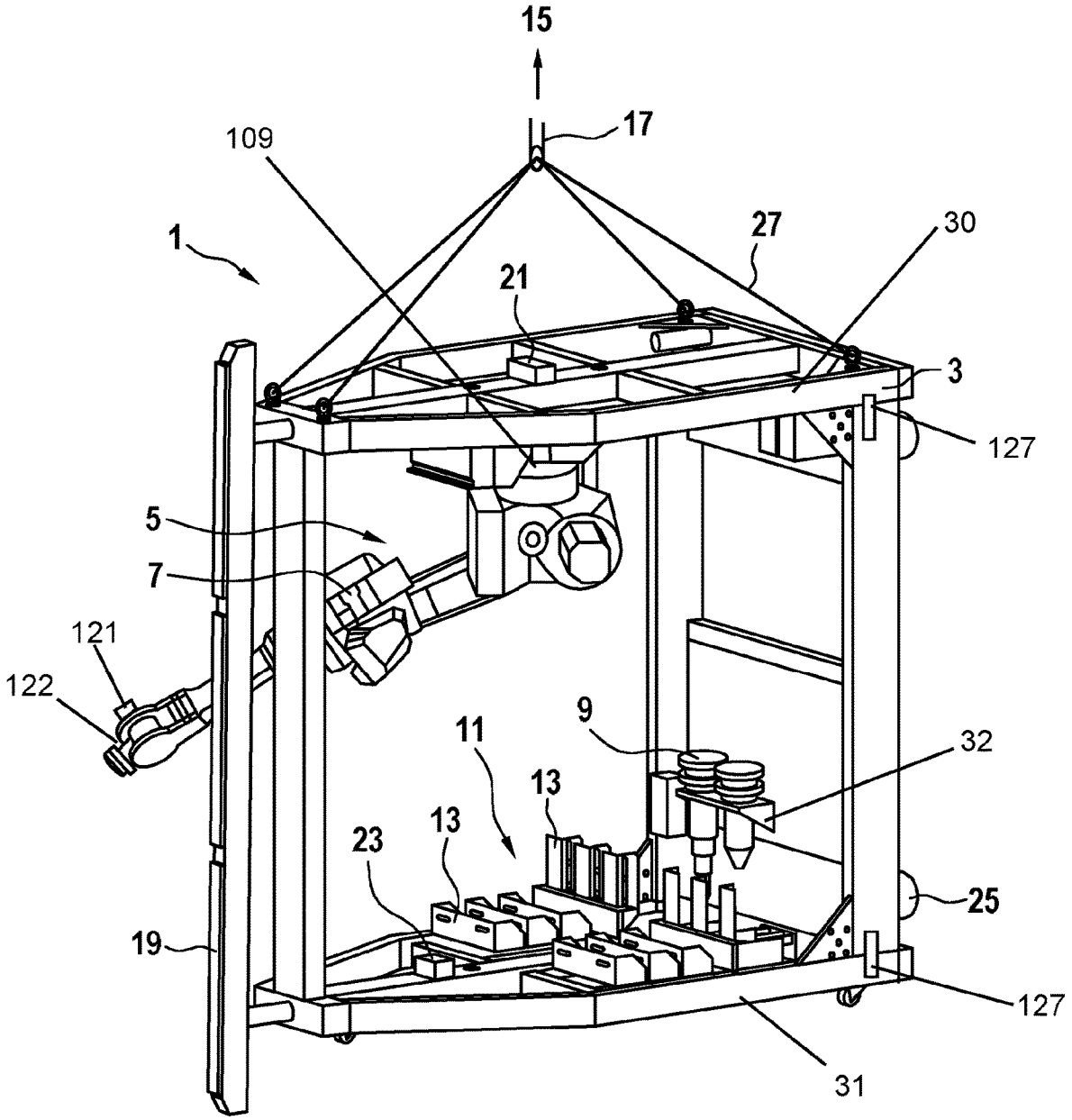
FIG. 2 is a perspective view of an assembly device.

FIG. 2 is an enlarged view of an assembly device 1 according to an embodiment of the present invention.

The support component 3 is designed as a cage-like framework in which a plurality of horizontally and vertically extending bars form a mechanically load-bearing structure, and in particular form the upper part 30 and the lower part 31.

Retaining cables 27 that can be connected to the support means 17 are attached to the upper part 30 of the cage-like support component 3. By moving the support means 17 within the elevator shaft 103, i.e. for example by winding up or unwinding the flexible support means 17 onto or from a cable winch of the movement component 15, the support component 3 can thus be moved within the elevator shaft 103 in the main extension direction 108, and therefore vertically, so as to hang therein.

The fixing component 19 is provided on the side of the support component 3. In the example shown, the fixing component 19 is formed by an elongate bar extending in the vertical direction. A total of four props 25, only one of which is visible at the bottom and at the top, are provided on the rear face of the support component 3 opposite the fixing component 19. The props 25 can be moved in the horizontal direction relative to the framework of the support component 3. For this purpose, the props 25 can for example be attached to the support component 3 by means of a lockable hydraulic cylinder or a self-locking motor spindle. When the prop 25 is moved away from the framework of the support component 3, it moves laterally toward one of the walls 105 of the elevator shaft 103. In this way, the support component 3 can be locked within the elevator shaft 103 between the fixing component 19 and the props 25, and therefore the support component 3 is fixed within the elevator shaft 103 in the lateral direction and therefore in the fixing position while an assembly step is being carried out, for example. Forces that are introduced into the support component 3 can be transmitted to the walls 105 of the elevator shaft 103 in this state, preferably without the support component 3 being able to move or vibrate within the elevator shaft 103 in the process. In particular when the fixing component 19 is not in contact with a wall 105 of the elevator shaft 103 over its entire length, deformation of the support component 3 may occur. This is in particular the case if the fixing component 19 projects into a door cut-out in the elevator shaft 103.

In the embodiment shown, the mechatronic installation component 5 is implemented by means of an industrial robot 7. It is noted that the mechatronic installation component 5 can however also be implemented in another manner, for example by differently designed actuators, manipulators, effectors, etc. In particular, the installation component could comprise mechatronics or robotics specially adapted to use in an installation process within an elevator shaft 103 of an elevator system 1.

In the example shown, the industrial robot 7 is equipped with a plurality of robot arms that can pivot about pivot axes. For example, the industrial robot may have at least six degrees of freedom, i.e. an assembly tool 9 guided by the industrial robot 7 can be moved with six degrees of freedom, i.e. for example with three rotational degrees of freedom and three translational degrees of freedom. For example, the industrial robot may be designed as a vertical articulated arm robot, a horizontal articulated arm robot or SCARA robot, or as a Cartesian robot or gantry robot.

The robot can be coupled at its self-supporting end to various assembly tools or sensors 9 which are retained in a first magazine 32 arranged on the support component 3. The assembly tools or sensors 9 may differ from one another in terms of design and intended purpose. The assembly tools or sensors 9 may be retained on the support component 3 such that the self-supporting end 122 of the industrial robot 7 is moved toward said tools or sensors and can be coupled to one of said tools or sensors. By means of the assembly tools 9, the industrial robot can receive components 13 to be installed or fastening screws (not explicitly shown). The assembly tools and sensors 9, and the consumable materials in the form of components 13 to be installed and fastening screws, are referred to here as assembly means or assembly apparatuses.

One of the assembly tools 9 may be designed as a drilling tool, similar to a drilling machine. By coupling the industrial robot 7 to a drilling tool of this type, the installation component 5 can be configured to allow holes to be drilled for example in one of the walls 105 of the elevator shaft 103 so as to be controlled in an at least partly automated manner. Here, the drilling tool can for example be moved and handled by the industrial robot 7 such that the drilling tool drills holes for example in the concrete of the wall 105 of the elevator shaft 103 in an intended position using a drill, into which holes fastening screws can for example be subsequently screwed in order to fix fastening elements.

Another assembly tool 9 may be designed as a screwing device for at least semi-automatically screwing fastening screws into previously drilled holes in a wall 105 of the elevator shaft 103.

A second magazine 11 may also be provided on the support component 3. The magazine 11 can be used to store components 13 to be installed and to provide said components to the installation component 5.

In the example shown, the industrial robot 7 may for example automatically pick up a fastening screw from the magazine 11 and screw said screw into previously drilled fastening holes in the wall 105 using an assembly tool 9 designed as a screwing device, for example.

In the example shown, it is clear that, using the assembly device 1, assembly steps of an installation process in which components 13 are mounted on a wall 105 can be carried out in a completely or partly automated manner by the installation component 5 first drilling holes in the wall 105 and screwing fastening screws into said holes.

To control the installation component 5 and in particular the industrial robot 7, the assembly device 1 comprises a control apparatus 21 arranged on the upper part 30 of the support component 3. The control apparatus 21 is connected by signals to a sensor 121, which is arranged on a self-supporting end 122 of the industrial robot 7. The sensor 121 may be used as an alternative to a sensor 9 from a magazine 32. The sensor 121 is for example designed as a laser scanner, by means of which a distance from any desired object can be determined. The control apparatus 21 can therefore in particular determine the distance between the sensor 121 and a reference point 23 arranged on the lower part 31 of the support component 3. Since the control apparatus 21 knows the position of the industrial robot 7 and therefore also the position of the sensor 121 relative to the retaining device 109 and therefore relative to the support component 3, it can determine therefrom the position of the reference point 23 relative to the installation component 5, in particular relative to the retaining device 109. Therefore, the control apparatus 21 can determine an actual position of the reference point 23 in the fixing position, i.e. after the support component 3 has been fixed. By comparing the actual position with an initial position of the reference point 23 stored in the control apparatus 21 before the support component 3 is fixed, deformation of the support component 3 brought about by the fixing can be deduced. Proceeding from stored initial positions of the assembly means in the form of assembly tools 9 and components 13 to be installed and from the information regarding the deformation of the support component 3, the actual positions thereof can be determined. It is likewise possible for the actual positions of the two magazines 11, 32 to be determined, and for the actual positions of the individual assembly means 9, 13 to be determined relative thereto.

Figure 3:
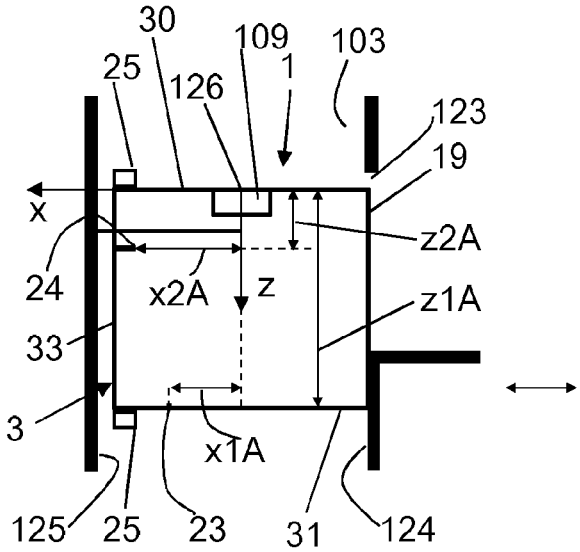
FIG. 3 is a simplified side view of an assembly device in an elevator shaft before fixing a support component.
Figure 4:
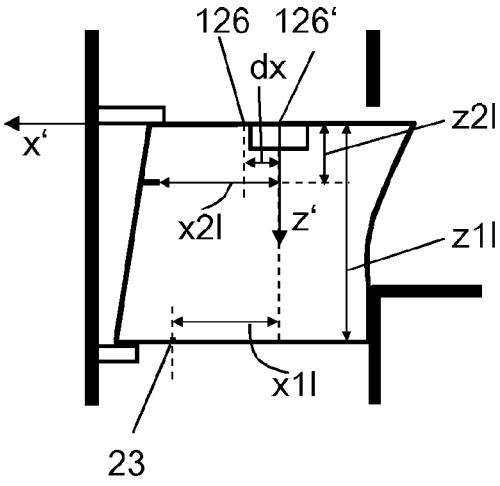
FIG. 4 is a simplified side view according to FIG. 3 after fixing a support component.

The approach when determining the actual positions of the assembly means 9, 13 is explained in greater detail on the basis of FIGS. 3 and 4. FIG. 3 is a simplified side view of the assembly device 1 in an elevator shaft 103 before the support component 3 is fixed, i.e. in an initial state, and FIG. 4 shows said support component after it has been fixed. The installation component 5 is not shown for the sake of clarity. Only the retaining device 109 is shown, which is arranged on the upper part 30 of the support component 3. In this case, the assembly device 1 is located in the region of a door cut-out 123 in a wall 105 in the form of a front wall 124 of the elevator shaft 103. The assembly device 1 is positioned such that the upper part 30 of the support component 3 is located in the region of the door cut-out 123 and the lower part 31 is located below the door cut-out 123. The fixing component 19 of the support component 3 may therefore be supported on the front wall 124 in the region of the lower part 31, but in the region of the upper part 30 there is no abutment to provide support. When locking the support component 3 by moving the props 25 toward a wall 105 in the form of a rear wall 125 of the elevator shaft 103, the support component 3 is pushed into the door cut-out 123 in the region of the upper part 30 and is contact with the front wall 124 in the region of the lower part 31 via the fixing component 19. Deformation of the support component 3 occurs as a result. This state is shown in FIG. 4.

In the initial state in FIG. 3, an initial coordinate system is assigned to the installation component, which has its origin 126 in the center of the upper face of the retaining device 109. The x axis extends horizontally toward the rear wall 125. The z axis extends vertically downwards, i.e. in the main extension direction of the elevator shaft 103, and a y axis (not shown) extends into the drawing plane. A first reference point 23 is arranged directly on the lower part 31 of the support component 3, and has an x coordinate x1A and a z coordinate z1A. A second reference point 24 is arranged on a side part 33 of the support component 3 opposite the fixing component 19, and has an x coordinate x2A and a z coordinate z2A. The y coordinate is not relevant in this view. In this case, the x coordinate x1A of the first reference point 23 is less than the x coordinate x2A of the second reference point 24. In this case, the z coordinate z1A of the first reference point 23 is greater than the z coordinate z2A of the second reference point 24. Said coordinates denote an initial position of the two reference points 23, 24 and are stored in the control apparatus 21 of the installation component 5. The distance of the coupling of the first reference point 23 in the main extension direction from the retaining device 109 therefore corresponds to the z coordinate z1A and the distance of the coupling of the second reference point 24 corresponds to the z coordinate z2A.

By fixing the support component 3 by means of the props 25 and the fixing component 19, the support component 3 is deformed such that the upper part 30 is displaced relative to the lower part 31 counter to the x direction, i.e. in the fixing direction. The origin of the coordinate system of the installation component 5 is therefore also displaced. The displaced origin is denoted by reference sign 126'. This results in an x' and a z' axis of the coordinate system. In a simplified manner, it is assumed that the distance between the upper part 30 and the lower part 31 remains the same, and that there is no displacement along the y axis and no rotation about one of the axes either. Therefore, the y and z coordinates of the reference points 23, 24 and of all the other elements of the installation component 3 remain unchanged and only the x coordinates change into x' coordinates.

In order to determine the x' coordinates after fixing relative to the displaced origin 126', the control apparatus 21 brings the sensor 121 into the vicinity of the first reference point 23 and, by means of the sensor 121, determines a distance in the x' direction between the sensor 121 and the first reference point 23. Since the control apparatus 21 knows the position and therefore the x' coordinate of the sensor 121, it can determine the x' coordinate x1I of the first reference point 23 in the fixing position by means of the measured distance from the sensor 121. Said coordinates denote an actual position of the first reference point 23. By comparing the x coordinate x1A in the initial position and the x' coordinate x1I in the fixing position, the control apparatus 21 can calculate the displacement of the origin 126' compared with the original origin 126. The z coordinate of the reference point 23 remains the same (z1A=z1I).

For all the assembly means that are likewise coupled to the support component 3 via the lower part 31, the x' coordinate changes by the same magnitude as for the first reference point 23. For the assembly means of which the coupling to the support component is a lower distance in the main extension direction from the retaining device 109, the magnitude of the change in the x' coordinate changes in proportion to the reduction in said distance.

An assembly tool 9 can be received using the calculated actual position thereof, and an assembly step, for example drilling a hole in a wall of the elevator shaft, can be carried out.

If the lower part 31 rather than the upper part 30 is displaced into the door opening 123 when fixing the support component 3, the same process is used. The only difference is that the origin 126 of the coordinate system remains unchanged and the first reference point 23 is displaced relative to the origin 126.

In order to also very precisely determine the magnitude of the change in the x' coordinate for assembly means of which the coupling to the installation component is a lower distance from the retaining device, in particular the same distance as the second reference point 24, the described method can be repeated using the second reference point 24 and the actual coordinate x2I of the second reference point 24 can be determined. With the second reference point 24 too, the z coordinate remains unchanged (z2I=z2A). For this purpose, in the same way as determining the actual position of the first reference point 23, the actual position of the second reference point 24 is determined. By comparing the coordinate in the initial position x2A and the actual coordinate x2I of the second reference point 24, the magnitude of the change in the x' coordinate of the reference point 24 in the x direction can be identified. For the assembly means of which the coupling to the support component is the same distance in the main extension direction from the retaining device 109 as the second reference point 24, the x' coordinate changes by the same magnitude as for the second reference point 24.

The reference points 23, 24 each in particular denote a position of a magazine for receiving assembly means.

Furthermore, actual positions of other reference points (not shown) can be determined, and can be analyzed and used as described.

Additionally or alternatively, deformation sensors 127 in the form of strain gages may be arranged at corners of the support component 3, by means of which gages stresses in the support component 3 can be measured in the fixing position. On the basis of the measured stresses, the deformation of the support component 3 is determined by means of a finite element calculation by the control apparatus 21.

Alternatively, the control apparatus 21 can also search for the actual position of relevant assembly means directly by means of the sensor 121, can store said positions and can then use them for planned assembly steps. In this case, the sensor 121 can in particular be designed as a 3D camera, the images from which are analyzed by means of image processing.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for carrying out an installation process in an elevator shaft of an elevator system comprising the steps of:

inserting an assembly device into the elevator shaft, the assembly device including a support component, an installation component being a mechatronic installation component that is retained by the support component, a control apparatus for controlling the installation component, and an assembly means arranged on the support component;

fixing the support component in a fixing position in the elevator shaft;

determining an actual position of the assembly means relative to the installation component based on an initial position of the assembly means stored in the control apparatus and based on a deformation of the support component brought about by the fixing in the fixing position;

receiving the assembly means by the installation component using the actual position of the assembly means; and carrying out an assembly step with the installation component using the received assembly means.

2. The method according to claim 1 including at least two magazines arranged on the support component for retaining the assembly means and a plurality of additional assembly means and determining an actual position of each of the assembly means in the magazines.

3. The method according to claim 1 including identifying the deformation of the support component from an actual position of at least one reference point of the support component measured by a sensor when the support component is in the fixing position and an initial position of the at least one reference point before the fixing of the support component, the initial position being stored in the control apparatus.

4. The method according to claim 3 including measuring the actual position of the at least one reference point contactlessly.

5. The method according to claim 3 including arranging the sensor on the installation component before the support component is fixed.

6. The method according to claim 5 wherein the sensor is rigidly arranged on the installation component.

7. The method according to claim 1 including arranging at least one deformation sensor on the support component for measuring a magnitude of the deformation of the support component.

8. The method according to claim 7 including measuring stresses in the support component by the at least one deformation sensor, and determining the deformation of the support component from the measured stresses.

9. An assembly device for carrying out an installation process in an elevator shaft of an elevator system comprising:

a support component;

an installation component being a mechatronic installation component retained on the support component; and a control apparatus for determining an actual position of an assembly means, arranged on the support component, relative to the installation component based on an initial position of the assembly means stored in the control apparatus and a deformation of the support component brought about by a fixing of the support component in a fixing position in the elevator shaft, and the control means actuating the installation component using the actual position of the assembly means to receive the assembly means and carry out an assembly step using the received assembly means.

10. The assembly device according to claim 9 including a sensor rigidly arranged on the installation component for measuring the actual position based on a reference point on the support component.

11. The assembly device according to claim 9 including at least one deformation sensor arranged on the support component for measuring a magnitude of the deformation of the support component.

12. The assembly device according to claim 11 wherein the at least one deformation sensor is adapted to measure stresses in the support component, and wherein the control apparatus determines the deformation of the support component from the measured stresses.

13. A method for carrying out an installation process in an elevator shaft of an elevator system comprising the steps of:

inserting an assembly device into the elevator shaft, the assembly device including a support component, an installation component being a mechatronic installation component that is retained by the support component, a control apparatus for controlling the installation component, and an assembly means arranged on the support component;

fixing the support component in a fixing position in the elevator shaft;

determining an actual position of the assembly means relative to the installation component, wherein the installation component is retained by the support component by a retaining device, and the actual position of the assembly means is determined relative to the retaining device;

receiving the assembly means by the installation component using the actual position of the assembly means; and carrying out an assembly step with the installation component using the received assembly means.

* * * * *